US006520511B2

(12) United States Patent
Gonthier

(10) Patent No.: US 6,520,511 B2
(45) Date of Patent: Feb. 18, 2003

(54) DEVICE FOR RETAINING A BOOT ON A GLIDING BOARD ADAPTED TO SNOWBOARDING

(75) Inventor: Jean-François Gonthier, Viuz la Chiesaz (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/769,460

(22) Filed: Jan. 26, 2001

(65) Prior Publication Data

US 2001/0010418 A1 Aug. 2, 2001

(30) Foreign Application Priority Data

Jan. 28, 2000 (FR) ..... 00 01268

(51) Int. Cl.[7] ..... A63C 9/00
(52) U.S. Cl. ..... 280/11.36; 280/14.22
(58) Field of Search ..... 280/11.3, 14.21, 280/14.22, 14.24, 617, 618, 633, 11.36, 87.042; 36/117.1, 173; 441/68, 74

(56) References Cited

U.S. PATENT DOCUMENTS

| | | | | | |
|---|---|---|---|---|---|
| 2,819,907 | A | * | 1/1958 | Thoresen | 280/87.042 |
| 3,801,119 | A | * | 4/1974 | Andre | 29/618 |
| 4,268,062 | A | * | 5/1981 | Wittmann | 280/618 |
| 4,284,292 | A | * | 8/1981 | Faulin | 280/618 |
| 5,894,684 | A | | 4/1999 | Sand et al. | 36/117.1 |
| 5,946,827 | A | | 9/1999 | Okajima | 36/58.5 |
| 5,967,531 | A | | 10/1999 | Saillet | 280/11.36 |
| 6,123,342 | A | * | 9/2000 | Grell | 280/11.36 |
| 6,231,057 | B1 | * | 5/2001 | Reuss et al. | 280/14.21 |

FOREIGN PATENT DOCUMENTS

| | | | | |
|---|---|---|---|---|
| DE | 28 02 251 A1 | * | 7/1979 | 280/633 |
| EP | 0797936 | | 10/1997 | |
| EP | 0838248 | | 4/1998 | |
| EP | 0 985 357 A1 | * | 3/2000 | A43B/5/04 |
| GB | 28793 | * | 2/1898 | 280/633 |
| WO | WO98/31247 | | 7/1998 | |

* cited by examiner

*Primary Examiner*—Frank Vanaman
(74) *Attorney, Agent, or Firm*—Greenblum & Bernstein, P.L.C.

(57) ABSTRACT

A device for retaining a boot on a gliding board adapted to snowboarding. The device includes a base, an arrangement to retain the boot on the base, and a rear support element, the latter having at least one lateral lug, The device has at least one friction plate that projects at least partially with respect to an inner surface of the lug, the friction plate having a friction structure provided to oppose the separation of the upper with respect to a front surface of the rear support surface.

22 Claims, 3 Drawing Sheets

DEVICE FOR RETAINING A BOOT ON A GLIDING BOARD ADAPTED TO SNOWBOARDING

BACKGROUND OF THE INVENTION

1. Field of the Invention

The present invention relates to the field of devices for retaining a boot on a gliding board adapted to snowboarding.

2. Description of Background and Relevant Information

In snowboarding, a user has both feet retained on a board, the feet being oriented substantially along a transverse direction of the board.

Certain devices are provided to retain flexible boots on the board, whereas others are provided to retain rigid boots.

In the case of flexible boots, a device is generally provided with a rear support element, such that the user can transmit forces to the board with the rear of the lower leg.

Certain devices also have a lateral lug, or enlargement, associated with the rear support element. The lateral lug has an inner surface that extends along the boot upper, at the area of one side of the lower leg. The lug is provided such that the user can transmit forces to the board, along a substantially longitudinal direction of the board.

That is the case, for example, when the user offsets the center of gravity of his body toward one end of the board.

The lug is also provided to transmit certain ground reactions on the board to the user. This is particularly useful in negotiating a turn having a large radius of curvature at high speed.

The devices provided with lugs improve the precision and control when operating the board, as compared with devices without lugs.

However, it has been shown that the improvement is not permanent. Indeed, the boot sometimes does not remain in contact with the lug when the user presses to transmit a force, or when the board restores a ground reaction.

SUMMARY OF THE INVENTION

An object of the invention is especially to ensure that the boot upper remains in contact with the lug, or enlargement, when the user presses down to transmit a force along a substantially longitudinal direction of the board, or when the board restores the ground reactions.

A device for retaining a boot on a gliding board adapted to snowboarding, according to the invention, includes a base provided to at least partially receive the boot sole, a mechanism provided to retain the boot on the base, and a rear support element provided to receive the boot upper in the rear of the user's lower leg, by contact with a front surface of the rear support element, the rear support element having at least one lateral lug, or enlargement, the lateral lug having an inner surface provided to extend along the boot upper on one side of the user's lower leg.

The device according to the invention has at least one friction plate that projects at least partially with respect to the inner surface of lug, the friction plate having a friction surface provided at least to oppose a spacing of the upper with respect to the front surface of the rear support surface.

As a result, the portion of the upper located on one side of the lower leg remains more often in contact with the lug when the user presses down to transmit a force along the length of the board, or when the board restores the ground reaction also lengthwise.

As a result, the steering precision and control are advantageously better.

BRIEF DESCRIPTION OF DRAWINGS

Other characteristics and advantages of the invention will be better understood from the description that follows, with reference to the annexed drawings showing, by way of non-limiting examples, how the invention can be embodied, and in which.

DETAILED DESCRIPTION OF THE INVENTION

The first example is described hereinafter with reference to FIGS. 1–4.

Figure 1:
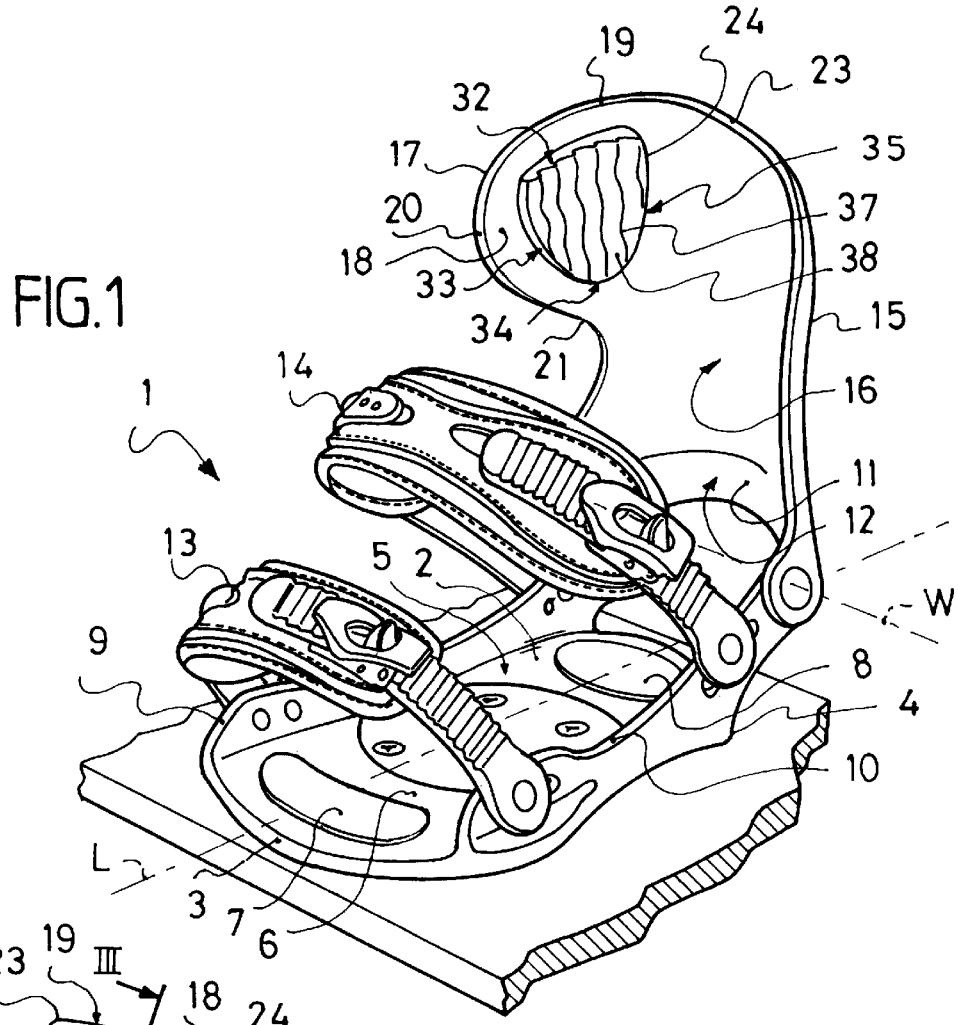
FIG. 1 is a perspective view of a first example of a retaining device according to the invention.

A device 1 for retaining a boot on a board is shown in perspective in FIG. 1.

For reasons of convenience, the boot is not shown.

In a known fashion, the device 1 includes a base 2 provided to at least partially receive the boot sole. The base 2 has a front end 3 and a rear end 4 which demarcate its length along a longitudinal direction L of the device 1. The base 2 has an upper surface 5 provided to be opposite the sole, as well as a lower surface 6 provided to be opposite the board, the upper 5 and lower 6 surfaces being opposite with respect to the thickness of the base 2.

The longitudinal direction L of the device 1 is the same as that of the boot, when the latter is retained on the device 1.

Preferably, the base 2 is provided with a front cushion 7 and rear cushion 8 that project, respectively, with respect to the upper surface 5. Each cushion 7, 8 is affixed to the base by a means such as nesting, gluing, or the like. The cushions are provided to receive the boot sole.

The device 1 also has an outer side that includes an outer lateral edge 9, and an inner side that includes an inner lateral edge 10. Each of the edges 9, 10 projects with respect to the upper surface 5. The edges 9, 10 are oriented substantially along a longitudinal direction L.

The inner lateral edge 10, on the medial side of the device, is a side located inward of the user's foot, when the foot is retained by the device. As a result, the inner lateral edges of two devices affixed to the same board are side-by-side.

The outer lateral edge 9, on the lateral side of the device, is located outward of the user's foot, when the foot is retained by the device.

An arch 11 connects the lateral edges 9, 10 to one another in the rear end 4 of the base 2. The arch 11 has a front surface 12 provided to receive the heel of the boot.

Retaining members, shown in the form of linkages 13, 14, or straps, are provided to removably retain the boot on the device 1. The linkages 13, 14, which can be opened or closed by the user, connect the lateral edges 9, 10, respectively.

A rear support element 15 is affixed to the base 2 as follows.

The rear support element 15 is journalled by any known means on the lateral edges 9, 10, along a transverse axis W of the device 1.

The transverse axis W fits in a plane substantially parallel to the lower surface 6 of the base 2, and is oriented in a transverse direction substantially perpendicular to the longitudinal direction L.

The rear support element 15 has a front surface 16, whose incurved shape is provided to surround the boot upper in the rear of the user's lower leg.

A lateral lug 17, which extends the rear support element 15 on the outer, i.e., the lateral, edge of the device 1, has an inner surface 18 provided to extend along the boot upper on one side of the user's lower leg. Preferably, the lateral lug 17 and the rear support element 15 form a unitary piece.

As a result, the lateral lug 17 has a perimeter demarcated by an upper band 19, a front band 20, a lower band 21, and a portion of the rear support element 15.

Figure 2:
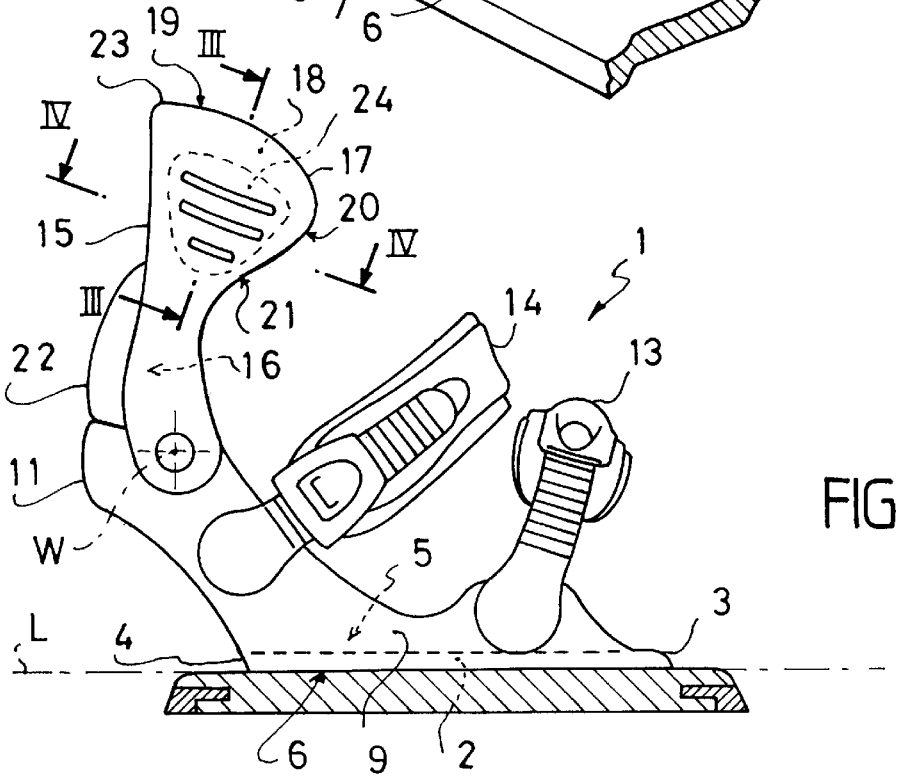
FIG. 2 is a side view of the device of FIG. 1.

FIG. 2 shows additional aspects of the device 1.

An abutment 22, adjustably affixed by any means to the rear support element 15, limits a rotation of the latter along the transverse axis W. When the abutment 22 is in support on the arch 11, an upper end 23 of the rear support element 15 can no longer move away from the front end 3 of the base 2.

In this case, the user can take rear supports with the lower leg by pressing on the front surface 16 along the longitudinal direction L.

According to the invention, a friction plate 24 projects, at least partially, with respect to the inner surface 18 of the lug 17. The plate 24 has friction material, or a friction layer, provided to oppose the sepron of the boot upper with respect to the front surface 16 of the rear support element 15, as will be explained hereinafter.

In fact, the lateral lug 17, i.e., the lateral portion of the rear support element 15, includes a lateral enlarged area on which the aforementioned friction plate 24, or other friction-increasing arrangement, is positioned. This enlarged area of the lateral portion 17 of the rear support plate can be considered to be constituted by an extent to which the lateral portion 17 is larger than the medial portion of the rear support element. It can be seen in FIG. 1 that, although the rear support element is forwardly concave and has a slight medial portion, the medial portion does not extend forwardly and is not enlarged in the manner of the lateral portion 17.

Figure 3:
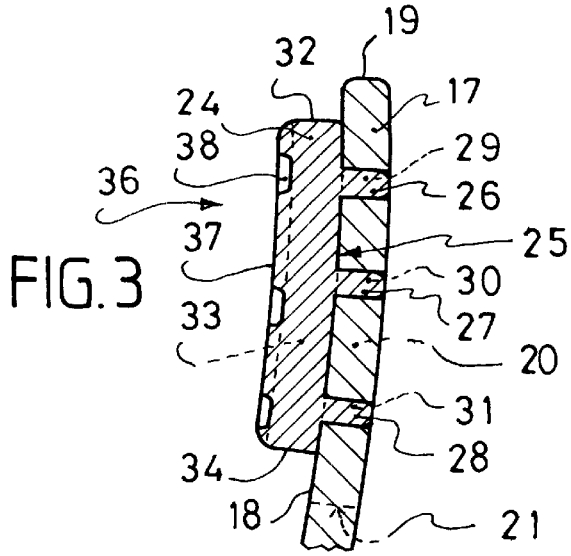
FIG. 3 is a cross-sectional view taken along the line III—III of FIG. 2.
Figure 4:
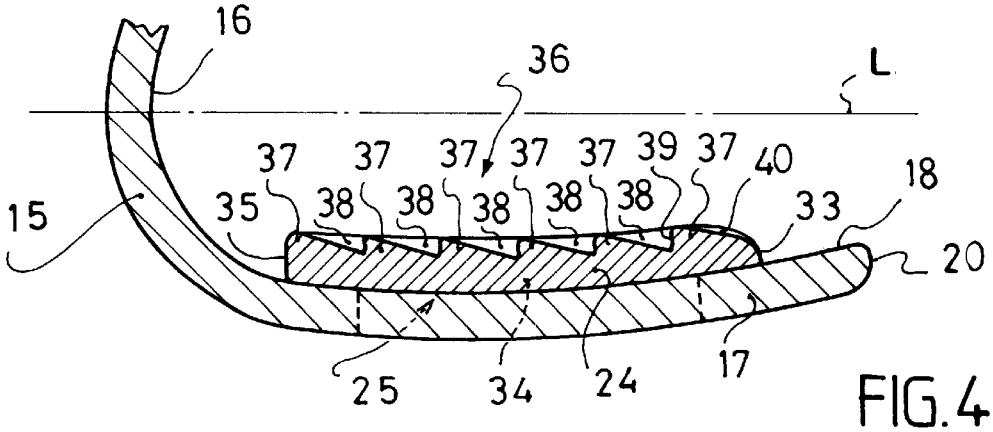
FIG. 4 is a cross-sectional view taken along the line IV—IV of FIG. 2.

Preferably, as is better understood with reference to FIGS. 3 and 4, the friction plate 24 is a piece affixed to the lateral lug 17 of the rear support element 15.

An aviation surface 25 of the friction plate 24 takes support on the inner surface 18 of the lug 17. Ribs 26, 27, 28 of the friction plate 24, projecting with respect to the affixation surface 25, are housed in cavities 29, 30, 31 of the lug 17. Preferably, the shapes of the ribs and of the cavities are complementary.

The attachment of the friction plate 24 to the lateral lug 17 is obtained, for example, by gluing the affixation surface 25 on the inner surface 18, by tightly fitting the ribs 26, 27, 28 of the friction plate 24 in the cavities 29, 30, 31 of the lug 17, or by combining these means.

The perimeter of the friction plate 24 is demarcated by an upper band 32, a front band 33, a lower band 34, and a rear band 35.

The friction arrangement, provided to oppose separation of the boot upper with respect to the front surface 16 of the rear support element 15, are obtained by an alternation of projections and recesses arranged on a friction surface 36 of the plate 24.

The affixation surface 25 is opposite the friction surface 36 with respect to the thickness of the plate 24.

Preferably, each projection is formed by a tooth 37 which extends along the surface 36, substantially from the upper band 32 to the lower band 34.

The surface 36 thus includes a series of teeth 37 between the front band 33 and the rear band 35. The teeth are separated by grooves 38.

The teeth 37 are provided to cooperate with the boot upper as follows, when the upper is in support on the friction surface 36 of the plate 24.

The shape of the teeth enables a sliding of the upper toward the front surface 16 of the rear support element 15, but opposes the separation of the upper with respect to the front surface 16, in the manner of fish scales with respect to water.

As shown by means of FIG. 4, for the tooth 37 that is the closest to the front band 33, for example, each tooth has a particular geometry. A tooth 37 has a first surface 39 substantially perpendicular to the longitudinal direction L, as well as a second surface 40 that forms, together with the first surface 39, an angle that is comprised between 10 and 80 degrees.

For a given tooth, the second surface 40 is further away from the rear band 35 than the first surface 39. This means that the second surface 40 is farther away from the front surface 16 of the rear support surface 15 than the first surface 39.

The top of each tooth, defined by the edge extending from the intersection of the first surface 39 with the second surface 40, tends to penetrate into the boot upper when the user presses on the lug 17. In view of the fact that the transverse direction of the device corresponds substantially to the longitudinal direction of the board when the device is affixed thereon, the user can easily transmit support forces toward one end of the board by pressing on the lug 17. The upper tends to remain in contact with the lug.

As can be best understood with reference to FIGS. 1 and 3, the teeth 37 and the grooves 38 have a corrugated shape between the upper band 32 and the lower band 34. This means that the edge of a tooth alternatively comes close to and moves away from the front band 33 or the rear band 35, when moving over the friction plate 24 from the upper band 32 to the lower band 34.

This structure makes it possible to increase the friction forces between the boot upper and the friction plate 24, in the direction that extends from the lower band 34 to the upper band 32. As a result, the user advantageously has better control over the lateral support forces exerted on the lug 17.

The device 1 can be made according to all the techniques known to a person with ordinary skill in the art.

In particular, the base 2, the outer 9 and inner 10 edges, and the arch 11 preferably form a unitary piece made, for example, of a rigid plastic material.

The assembly constituted by the rear support element 15 and the lug 17 is also preferably made of a rigid plastic material.

The friction plate 24 can be made of a flexible plastic meal such as polyurethane, silicone, or rubber. It can also be made of a more rigid plastic material.

Preferably, the friction plate 24 is made out a material that has a lower rigidity than the rigidity of the constituent material of the lug 17.

Two additional embodiments of the invention are presented hereinafter with reference to FIGS. 5 and 6. Given that they each differ only slightly from the first example, only the differences are made apparent.

Figure 5:
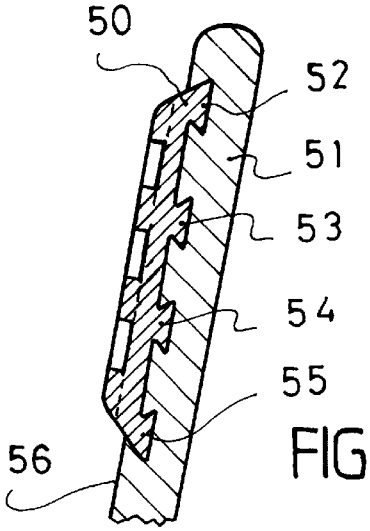
FIG. 5 is a cross-sectional view similar to that of FIG. 3, for a second example of embodiment of the invention.

The second example is shown in FIG. 5.

The difference, with respect to the first example, lies in the means for affixing a friction plate 50 to a lateral lug 51 of a retaining device. Cavities 52, 53, 54, 55 of the lug 51 have undercuts in the form, for example, of a dovetail. The plate 50 is duplicate molded on the inner surface 56 of the lug 51, such that the cavities are filled by the constituent material of the plate.

This method avoids assembling and gluing operations.

Figure 6:
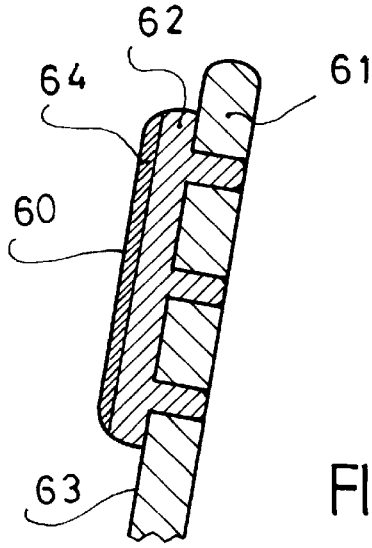
FIG. 6 is a cross-sectional view similar to that of FIG. 3, for a third example of embodiment of the invention.

The third example is shown in FIG. 6.

The difference, with respect to tile first example, lies in the structure of a friction plate 60 affixed to a lateral lug 61.

The friction plate 60 is obtained by superposing at least two layers of materials. An inner layer 62 is affixed to the lug 61, on the side of the inner surface 63 of the lug. An outer layer 64 is affixed to the inner layer 62, for example by an adhesive material, so as to contact the boot upper. The layer 64 is a friction layer that acts preferably in any direction parallel to the inner surface 63 of the lug 61. The outer layer 64 can be made in a single or several parts. Preferably, the inner 62 and outer 64 layers are each made of a material of different rigidity.

The invention is not limited to the examples described hereinabove, and includes all of the technical equivalents that fall within the scope of the claims that follow.

In particular, one can provide a device to include a single outer lug, a single inner lug, or an outer lug and an inner lug.

One can also provide that a friction plate be constituted of several distinct parts, or that a same lug be provided with a plurality of friction plates.

Still one can provide that a lug and the associated plate form a unitary piece. In this case, if the lug and the rear support element are integral, then the assembly including tie rear support element, the lug and the plate, is integral.

The ribs of a plate, provided to be housed in cavities of the lug, can be replaced by protuberances of any shape.

For example, cylindrical pins projecting on the plate can be housed in holes of the lug.

The projections and the recesses, arranged on the friction surface of a plate, can have any appropriate form. In particular, a projection can be a pin having a cylindrical, square, triangular, or any other shape.

Figure 7:
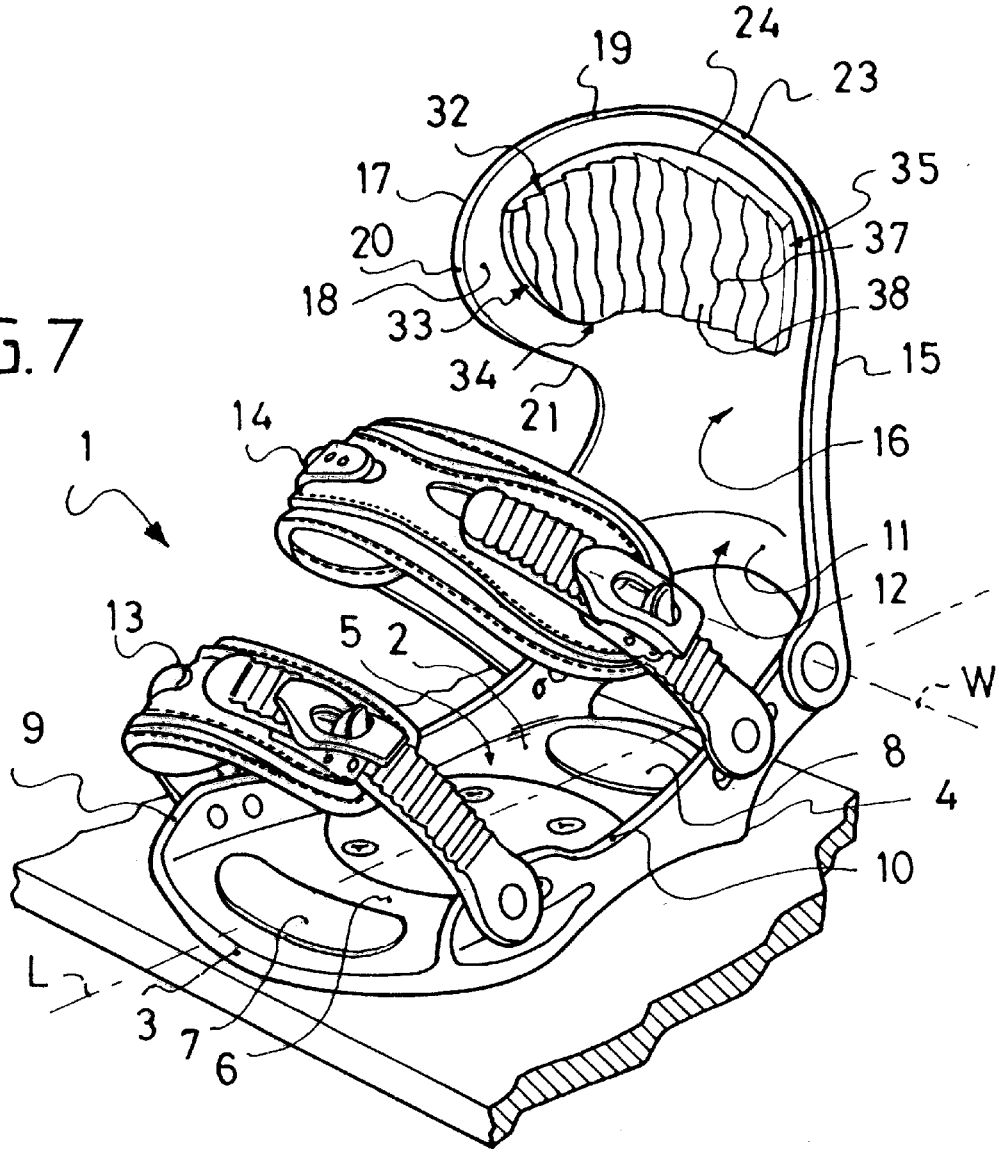
FIG. 7 is a perspective view, similar to FIG. 1, showing an alternate embodiment of the invention.

One can also provide that the friction plate cover both the inner surface of the lug and at least a portion of the front surface of the rear support element, as shown in FIG. 7.

The instant application is based upon French Patent Application No. 00 01268, filed Jan. 28, 2000, the disclosure of which is hereby incorporated by reference thereto in its entirety, and the priority of which is hereby claimed under 35 U.S.C. §119.

What is claimed is:

1. A device for retaining a boot on a gliding board adapted to snowboarding, said device comprising:

a base provided to at least partially receive the boot sole, an arrangement provided to retain the boot on the base, and a rear support element provided to receive the boot upper in the rear of a user's lower leg, by contact with a front surface of the rear support element, the rear support element having at least one lug on a side of the device, the lug having an inner surface provided to extend along the boot upper on one side of the user's lower leg, the lug having at least one friction arrangement projecting at least partially with respect to the inner surface of at least the lug, the friction arrangement having a friction structure provided at least to increase friction and oppose a separation of the upper with respect to the front surface of the rear support element.

2. A retaining device according to claim 1, wherein the friction arrangement comprises an alternation of projections and recesses arranged on a friction surface of a friction plate.

3. A retaining device according to claim 2, wherein each projection is a tooth that extends along the friction surface between an upper band and a lower band of the friction plate, and wherein the recesses are grooves that separate the teeth.

4. A retaining device according to claim 3, wherein the teeth and the grooves have a corrugated shape between the upper band and the lower band.

5. A retaining device according to claim 3, wherein each of the teeth are at least partially formed by a surface extending between 10 and 80 degrees to a longitudinal direction.

6. A retaining device according to claim 1, wherein the friction structure comprises ribs which are housed in cavities of the lug.

7. A retaining device according to claim 1, wherein the friction structure is made of a material that has a lower rigidity than the rigidity of the constituent material of the lug.

8. A retaining device according to claim 1, wherein the lug is located on a lateral side of the device, the lug thereby constituting a lateral lug.

9. A retaining device according to claim 1, wherein the friction arrangement is asymmetrical with respect to a central vertical longitudinal plane and wherein the friction arrangement covers the front surface of the rear support element and the inner surface of the lug.

10. A retaining device according to claim 1, wherein the lug is unitary with the rear support element.

11. A snowboard binding comprising:

a base adapted to be affixed to an upper surface of a snowboard, said base being provided to at least partially support a sole of a boot;

a rear support element connected to said base, said rear support element positioned to receive at least a rear portion of an upper of the boot, said rear support element comprising a medial portion, a rear portion, and a lateral portion, said lateral portion including a lateral enlarged area, said lateral enlarged area of said lateral portion being constituted by an extent to which said lateral portion is larger than said medial portion;

at least one friction-increasing arrangement to increase friction and oppose separation of the upper of the boot and said rear support element, said friction-increasing arrangement extending from an inner surface of at least said lateral enlarged area of said lateral portion of said rear support element.

12. A snowboard binding according to claim 11, further comprising boot retention members extending transversely from opposite lateral edges of said base.

13. A snowboard binding according to claim 12, wherein said boot retention members comprise a plurality of straps, each said strap having an end connected to a respective one of said lateral edges of said base.

14. A snowboard binding according to claim 11, wherein said rear support element is journalled to opposite lateral edges of said base.

15. A snowboard binding according to. claim 11, wherein said friction-increasing arrangement comprises a friction plate attached at least to said inner surface of at least said lateral enlarged area of said lateral portion of said rear support element, said friction plate having an alternation of recesses and projections.

16. A snowboard binding according to claim 15, wherein said recesses and projections extend in a generally upward direction.

17. A snowboard binding according to claim 15, wherein each said projection is a tooth extending between an upper band of said friction plate to a lower band of said friction plate, and wherein each said recess is a groove separating a pair of said teeth.

18. A snowboard binding according to claim 17, wherein said teeth and said grooves have a corrugated shape between said upper and lower bands of said friction plate.

19. A snowboard binding according to claim 11, wherein said friction-increasing arrangement comprises ribs housed in cavities of at least said lateral enlarged area of said lateral portion of said rear support element.

20. A snowboard binding according to claim 11, wherein said friction-increasing arrangement is made of a material having a lower rigidity than a rigidity of a constituent material of said lateral portion of said rear support element.

21. A snowboard binding according to claim 11, wherein said lateral portion is unitary with the rear support element.

22. A snowboard binding comprising:

a base adapted to be affixed to an upper surface of a snowboard, said base being provided to at least partially support a sole of a boot;

a rear support element connected to said base, said rear support element positioned to receive at least a rear portion of an upper of the boot, said rear support element comprising a medial portion, a rear portion, and a lateral portion, said lateral portion comprising a lateral enlarged area, said lateral enlarged area of said lateral portion being constituted by an extent to which said lateral portion is larger than said medial portion;

means for increasing friction between the upper of the boot and for opposing separation of the upper of the boot from said rear support element, said means extending from an inner surface of at least said lateral enlarged area of said lateral portion of said rear support element.

* * * * *